United States Patent [19]

Tsujimoto et al.

[11] Patent Number: 4,654,286

[45] Date of Patent: Mar. 31, 1987

[54] METHOD OF REMOVING A CHARGE FROM AN ELECTROPHOTOGRAPHIC PHOTORECEPTOR

[75] Inventors: Yoshiharu Tsujimoto, Suita; Hiroshi Kinashi, Uji; Yuhi Yui, Nara; Tadashi Akiyama, Nara; Koichi Irihara, Nara, all of Japan

[73] Assignee: Sharp Kabushiki Kaisha, Osaka, Japan

[21] Appl. No.: 790,227

[22] Filed: Oct. 22, 1985

[30] Foreign Application Priority Data

Oct. 22, 1984 [JP] Japan ..... 59-222451

[51] Int. Cl.[4] ..... G03G 13/24

[52] U.S. Cl. ..... 430/97; 430/125; 355/15; 118/652

[58] Field of Search ..... 430/31, 55, 125, 97; 118/652; 355/15

[56] References Cited

U.S. PATENT DOCUMENTS

| | | | |
|---|---|---|---|
| 3,481,669 | 12/1969 | Roth et al. | 430/55 X |
| 3,536,483 | 10/1970 | Watanabe et al. | 430/55 |
| 3,819,262 | 6/1974 | Estandarte | 430/125 X |

*Primary Examiner*—J. David Welsh

*Attorney, Agent, or Firm*—Birch, Stewart, Kolasch & Birch

[57] ABSTRACT

Disclosed is a useful method of removing a charge from an electrophotographic photoreceptor provided with insulation layers on its surface by radiating light containing a minimum of 6,000 angstroms of peak wave length onto said photoreceptor simultaneously with a corona discharge. To realize this, a filter is applied so that light containing a minimum of 6,000 angstroms of peak wave length can be generated.

3 Claims, 3 Drawing Figures

METHOD OF REMOVING A CHARGE FROM AN ELECTROPHOTOGRAPHIC PHOTORECEPTOR

BACKGROUND OF THE INVENTION

The present invention relates to a method of removing a charge from an electrophotographic photoreceptor provided with surface insulation.

Conventionally, of a variety of electrophotographic photoreceptors provided with layers of surface insulation, the typical photoreceptors have triple layers comprised of the conductive layer, photoreceptive layer, and the insulation layer, respectively. Generally, the triple-layer photoreceptor is provided with satisfactory characteristics featuring high sensitivity and sharp contrast. In particular, the triple-layer photoreceptor provided with a photoreceptive layer comprised of cadmium sulfate dispersed into an organic binder has been widely used because of its high sensitivity and economy. Nevertheless, the photoreceptor still poses problems related to "compatible characteristics with darkness." This refers to the specific characteristics significantly noticeable in conventional triple-layer photoreceptors. The characteristics of these photoreceptors significantly vary when the photoreceptors are stored in a dark location for a long time. One of the critical problems caused by said "characteristics compatible with darkness" is the significantly variable concentration of developed pictures through successive use of a triple-layer photoreceptor after a certain storage period. This symptom is caused by variations in the static capacitance of the photoreceptor layer itself as the result of a gradual release of charges from the photoreceptive layer during the storage period. To solve this problem, some prior art devices attempted to minimize the picture concentration variations by applying "charge-removing" light. This was done by applying an electric field to the photoreceptor immediately before the picture formation process begins. Nevertheless, even after applying a large amount of "charge-removing" light, the concentration of the first picture that was developed using photoreceptors that were idle for a long time turned out to be significantly weak. Conversely, the picture concentration tended to increase during the continuous electrophotographic copying that followed. Conversely, when the amount of charge-removing light was too small, concentration significantly varied between the first and second pictures developed when photoreceptors once subjected to said "characteristics compatible with darkness" were used. Yet the picture image could be poorly developed. As a result, it was extremely difficult for conventional techniques to detect the optimum amount of light due to the different characteristics of each photoreceptor.

SUMMARY OF THE INVENTION

The present invention aims at providing a useful method of removing the charge from an electrophotographic photoreceptor. The method eliminates those disadvantages mentioned above and provides a stable concentration of the developed picture image through continuous copying even when using a photoreceptor that has been stored for a long time.

Other objects and further scope of applicability of the present invention will become apparent from the detailed description that follows. It should be understood, however, that the detailed description and specific examples, while indicating the preferred embodiments of the invention, are given by way of illustration only. Various changes and modifications within the spirit and scope of the invention will become apparent to those who are skilled in the art from the following detailed description.

To realize the above objectives, the preferred embodiments of the present invention provide a useful method of electrophotography employing a electrophotographic photoreceptor provided with layers of surface insulation. When removing the charge from a photoreceptor, a minimum of 6,000 angstroms of the peak wave length is radiated onto the photoreceptor simultaneously with the corona discharge.

BRIEF DESCRIPTION OF THE DRAWINGS

The present invention will be better understood from viewing the detailed description given below and the accompanying drawings which are given by way of illustration only and thus do not limit the present invention in which.

DETAILED DESCRIPTION OF THE PREFERRED EMBODIMENTS

Figure 1:
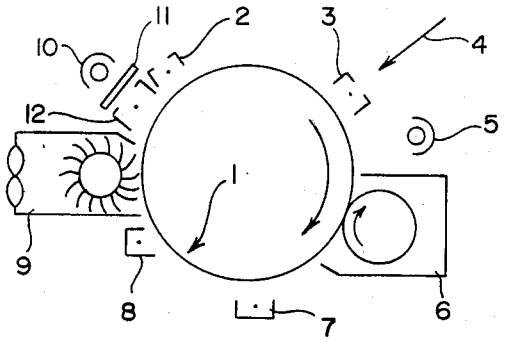
FIG. 1 is a schematic diagram of the electrophotographic copying machine realizing the method embodied by the present invention.
Figure 2:
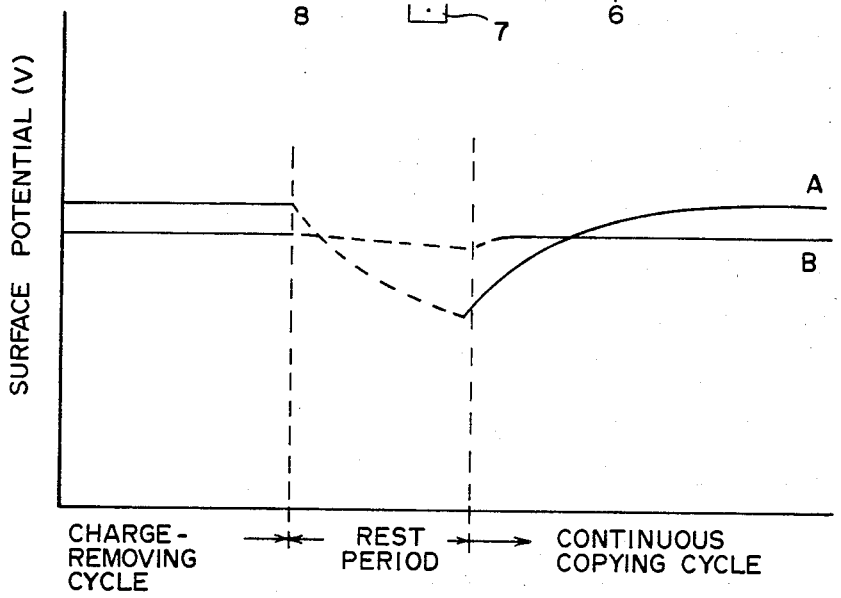
FIG. 2 is a graphic representation denoting variations of the surface potentials caused by the method of removing the charge from the photoreceptor which reflects the preferred embodiments of the present invention and conventional technique.
Figure 3:
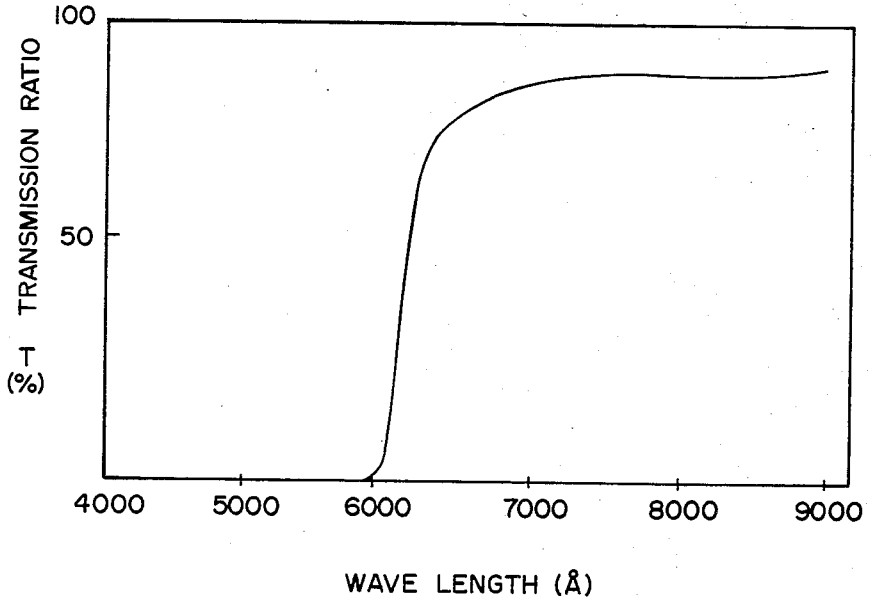
FIG. 3 is a chart denoting the spectral transmission characteristics of a filter used to implement removal of a charge from the photoreceptor reflecting the preferred embodiments of the present invention.

FIG. 1 is a schematic diagram denoting the electrophotographic copying machine realizing the method of removing a charge from the photoreceptor embodied by the present invention. In FIG. 1, reference number 1 indicates a photoreceptor which is provided with triple layers substantially comprised of an aluminum base, a middle layer of thin film 50 microns thick composed of cadmium sulfide powder dispersed in acrylic resin, and a top layer of film 20 microns thick composed of a thermally shrinkable polyester tube. Chargers 2 and 3, a full-surface exposure lamp 5, developer 6, a picture-image transfer unit 7, the first discharger 8, cleaner unit 9, discharge light source 10 used for removing the charge from the photoreceptor, filter 11, and the second discharger 12 are installed in the periphery of the triple-layer photoreceptor 1. Charger 2 causes said triple-layer photoreceptor 1 to be uniformly charged, while a certain amount of charge is applied to the surface of said triple-layer photoreceptor 1 by means of the inverse-polarity charger 3 simultaneously with radiation of the exposure light 4. Next, the full-surface exposure lamp 5 amplifies the contrast effect, and the latent picture image is then visualized by the developer 6. The developed image is then transferred onto copying paper (not shown) by the transfer unit 7. The first discharger 8 discharges a charge from the surface of the photoreceptor 1. Residual toner is then removed from the surface of the photoreceptor 1 by means of a cleaner unit 9. Finally, the charge is again removed from the surface of the photoreceptor 1 by applying a discharge light source 10, filter 11, and the second discharger 12. The method of removing the charge from said photoreceptor 1 reflects the preferred embodiments of the present invention and is implemented by combining the discharge light source 10, the filter 11, and the second discharger 12. In order to radiate light containing a minimum of 6,000 angstroms of the peak wave length, either the light source with a minimum of 6,000 angstroms of the peak wave length in the light spectrum band is directly applied, or the filter 11 is set in front of the light source such as a white light. The inventors introduce the latter method and repeatedly check the relationship between the wave length and the amount of lamp light by continuously performing copying operations after stopping the movement of the photoreceptor. This is done in order to prevent variations in the concentration of the developed picture. The inventors eventually detect satisfactory results when radiating a minimum of 6,000 angstroms of light on the photoreceptor 1. FIG. 2 graphically compares variations in the surface potentials advised by the conventional method vs. the new method of removing a charge from a photoreceptor. Reference A indicates the variations in the surface potential by using the conventional method of removing a charge from the photoreceptor. This method uses a light containing such a wave length that covers a wide band area. Reference B indicates the variations in the surface potential caused by the method of removing a charge from the photoreceptor by radiating light containing a minimum of 6,000 angstroms of the peak wave length reflecting the preferred embodiments of the present invention. FIG. 3 is a chart denoting the spectral transmission characteristics of the filter used to implement the method embodied by the present invention. Since the filter 11 is provided with the spectral transmission characteristics shown in FIG. 3, it effectively cuts off the wave components below 6,000 angstroms of light from light source 10. As is clear from FIG. 2-A, when the conventional method is applied the surface potential gradually lowers while the photoreceptor is stored due to "attenuation in darkness." Conversely, the surface potential gradually rises as soon as electrophotographic copying begins. As is clear from reference A of FIG. 2, the method of removing the charge from the photoreceptor embodied by the present invention does not cause the surface potential to lower even after a certain storage period. It is clear from the chart in FIG. 2 that the method of removing the charge from the photoreceptor reflecting the present invention is not substantially different from those surface potentials present in the first and ensuing copying operations, thus satisfactorily stabilizing the surface potential throughout the copying operation.

As is clear from the above detailed description, independent of the lay-off period, the electrophotographic photoreceptor securely stabilizes the surface potential and the picture concentration, just by setting a minimum of 6,000 angstroms of the peak wave length of light needed to remove the charge. This advantageous method can be easily implemented by applying a filter. Accordingly, the method embodied by the present invention is extremely useful for practical copying operations. While only certain embodiments of the present invention have been described, it will be apparent to those who are skilled in the art that various changes and modifications may be made therein without departing from the spirit and scope of the present invention as claimed hereinbelow.

What is claimed is:

1. In a method of charging and discharging a photoreceptor having surface insulation formed thereon during a photographic copying process, said process including in sequence a continuous copying cycle, a charge removing cycle and a rest period, said continuous copying cycle including steps wherein said photoreceptor is charged, a latent image is formed and said latent image is developed, said charge removing cycle removing the latent image from the photoreceptor by a charge applied by corona discharger means, the improvement comprising the step of:

applying a limited spectrum of light having wavelengths of only 6000 angstroms and above to said photoreceptor during the application of charge by said discharger means;

whereby the surface potential of said photoreceptor remains substantially constant throughout said continuous copying cycle, said charge removing cycle and said rest period.

2. The method of claim 1 wherein said step of applying a limited spectrum of light is performed by directing a broad spectrum of light toward said photoreceptor and filtering the broad spectrum to remove all wavelengths below 6000 angstroms.

3. A method according to claim 1, wherein said surface insulation formed on the surface of said photoreceptor includes a conductive layer, a photo-receptive layer, and an insulating layer.

* * * * *